United States Patent [19]

Faucher et al.

[11] 4,362,022

[45] Dec. 7, 1982

[54] ANTI-COKE FUEL NOZZLE

[75] Inventors: Joseph E. Faucher, East Hartford; Richard R. Wright, Willimantic; Francis C. Pane, Jr., South Windsor; David Kwoka, Windsor, all of Conn.

[73] Assignee: United Technologies Corporation, Hartford, Conn.

[21] Appl. No.: 126,256

[22] Filed: Mar. 3, 1980

[51] Int. Cl.[3] ..... F02C 7/22

[52] U.S. Cl. ..... 60/742

[58] Field of Search ..... 60/742; 239/404

[56] References Cited

U.S. PATENT DOCUMENTS

| | | | |
|---|---|---|---|
| 2,701,164 | 2/1955 | Purchas et al. | 60/742 |
| 2,959,003 | 11/1960 | Carlisle et al. | 60/742 |
| 3,685,741 | 8/1972 | O'Sickey | 60/742 |
| 4,157,012 | 6/1979 | Du Bell | 60/742 |

*Primary Examiner*—Robert E. Garrett

*Attorney, Agent, or Firm*—Norman Friedland

[57] ABSTRACT

Coke hereinbefore known to form in the secondary passage of a dual orifice fuel nozzle for the combustor of a turbine type power plant is prevented from forming by imposing increased air pressure in the secondary passage during its inoperative mode and when the primary fuel passage is in the operative mode, without relying on purging or requiring an external air source.

4 Claims, 3 Drawing Figures

ANTI-COKE FUEL NOZZLE

TECHNICAL FIELD

This invention relates to fuel nozzles for turbine types of power plants and particularly to dual orifice nozzles and means for preventing coke to buildup in the secondary fuel passage.

BACKGROUND ART

One of the incipient problems that has been plaguing the jet engine is the coke buildup particularly in the internal areas of the fuel nozzles. For this reason, the time interval between overhaul or repair or removal of these nozzles is not as long as it might be. Obviously, from a maintenance standpoint, this is not only a costly problem but a complex one since in many engines, a good part of the engine has to be torn down to get at these nozzles. Furthermore, coke buildup changes the nozzle spray characteristics affecting the efficiency of its operation, impairing the engine's overall operational efficiency and life.

Although the problem has persisted for a considerable time and many attempts to solve it have been made, none heretofore have met with any success. Typically, means have been provided to wash away external carbon deposits, as by blowing air over the surface where the deposition is apt to occur. Obviously, this solution anticipates the deposition of the carbon first and the blowing of air to remove the same. An example where this solution is described is in U.S. Pat. No. 3,788,067 granted to D. R. Carlisle and J. J. Nichols on Jan. 29, 1974. These solutions are generally applied where fuel tends to accumulate on the nozzles' surfaces during engine operation and after the engine is shut down. Upon operation and restarting, air is blown over those surfaces to remove any fuel residue.

We have found that we can obviate the problem in dual orifice nozzles, that is, in nozzles where there are primary and secondary fuel passages, where the primary or pilot nozzle is continuously operative and the secondary or main nozzle is only operative on the higher thrust levels of engine operation. For example, our invention has been particularly efficacious in fuel nozzles for such engines like the JT-8D and JT-9D manufactured by the Pratt and Whitney Aircraft Group of United Technologies Corporation. This invention contemplates pressurizing or increasing the pressure within the secondary fuel passage when only the primary fuel passage is operative. In this mode, flow of fuel from the primary passage and the surrounding airflow behaved as a jet pump creating a negative pressure in the secondary passage inducing fuel flow egressing from the primary nozzle to migrate therein and hence manifesting the buildup of coke.

The comprehension of this problem has been evasive to many people who attempted to solve it. Since the problem was never fully understood, its solution was not readily apparent. Thus, we have found that by the proper circuiting of airflow during the low thrust regimes, the air can be directed to build up the pressure in the secondary passage, eliminate the negative pressure heretofore created therein and prevent fuel from digressing therein.

DISCLOSURE OF THE INVENTION

An object of this invention is to provide for a gas turbine engine combustor an improved fuel nozzle.

A feature of this invention is to route engine air in a discrete manner so as to pressurize the secondary nozzle without actually purging with airflow (which is normally utilized only during the higher thrust engine operation) when the primary nozzle is solely operative in the lower thrust engine operation.

Other features and advantages will be apparent from the specification and claims and from the accompanying drawings which illustrate an embodiment of the invention.

BEST MODE FOR CARRYING OUT THE INVENTION

As noted above, the invention is essentially concerned with preventing coke from building up in the passageway of a fuel nozzle in a turbine type power plant and for the sake of convenience and simplicity, only that portion of the fuel nozzle is shown to illustrate the invention. For details of pressure atomizing and air atomized fuel nozzles, reference should be made to the fuel nozzles utilized on the JT-8D and JT-9D engines manufactured by Pratt and Whitney Aircraft Group of United Technologies Corporation. Suffice it to say that both of these engines utilize dual orifice fuel nozzles having pressure atomizing primary and pressure atomizing or air atomizing secondary nozzles where the primary nozzle is utilized for both low and high thrust engine operation and the secondary nozzle is operative only at the higher thrust regimes.

Figure 1:
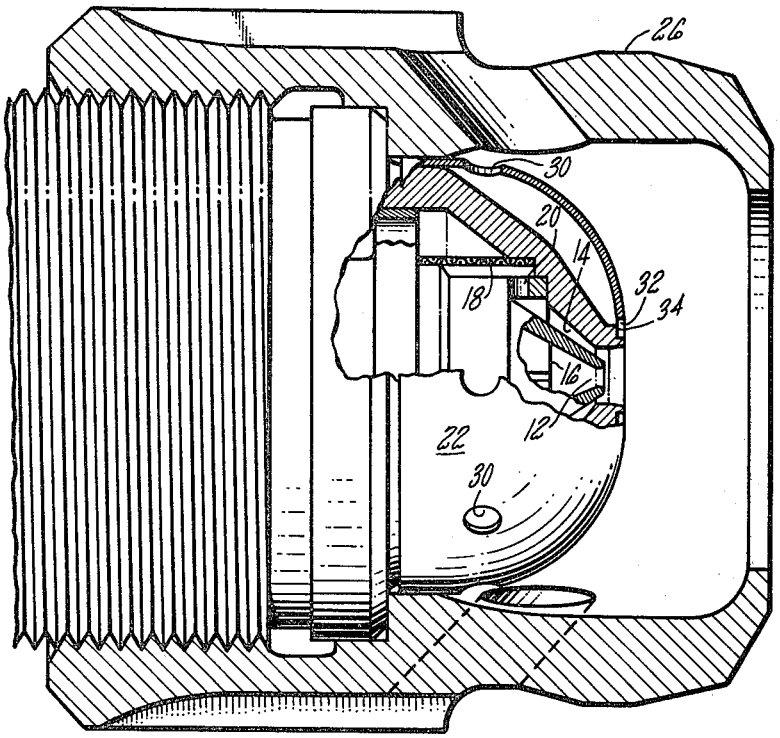
FIG. 1 is a partial view, partly in elevation and partly in section showing the details of this invention.
Figure 2:
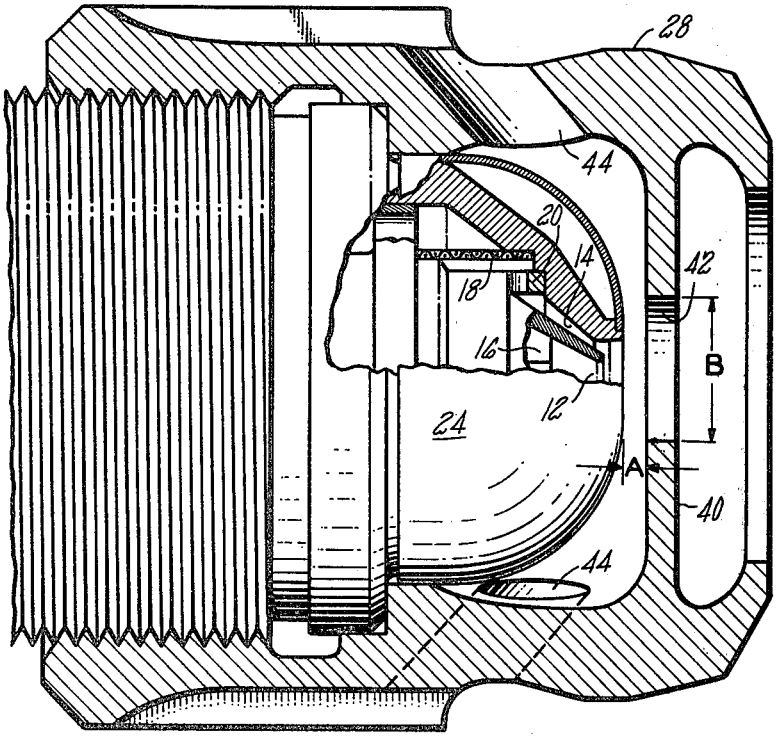
FIG. 2 is substantially identical showing of FIG. 1 with a slight modification illustrating another embodiment of the invention.

As can be seen in FIGS. 1 and 2, the nozzle and support is generally illustrated by reference numeral 10 which takes a generally conical shaped body defining a primary fuel passageway 12 for emitting fuel into the combustion zone (not shown) and a secondary annular passageway 14 also for emitting fuel into the combustion zone. The primary passageway may carry the conventional spring loaded pintle 16 and the secondary passageway may include the conventional filtering screen 18 and the metering ring 20.

As noted, FIG. 1 and FIG. 2 each have a dome shaped heat shield 22 and 24 respectively and each being modified as will be explained hereinbelow and each to carry a nozzle nut 26 and 28 also modified as will be explained hereinbelow.

The problem encountered in heretofore utilized dual orifice pressure atomized nozzles of the type described herein is that when the secondary fuel passageway 14 was rendered inoperative in the low thrust regimes, the pressure pattern in the vicinity of this passageway created by the fuel and swirling airflow generated a negative pressure in the secondary passageway 14. This manifested the tendency of fuel egressing from the primary fuel passageway 12 to ingress into the secondary passageway 14 and coke along the walls thereof.

To avoid this problem and in accordance with this invention the heretofore fuel nozzles were modified in the manner illustrated in FIGS. 1 and 2 to prevent the fuel from the primary nozzle to egress into the secondary nozzle when it was rendered inoperative. To achieve this end, the air pressure field in the vicinity of the secondary passageway 14 was slightly modified to create a positive pressure therein whenever the primary nozzle was the only nozzle in operation.

In FIG. 1, this anti-coking feature was accomplished by increasing the number of air holes 30 formed in heat shield 22 and defining a predescribed outlet annular opening 32 where the apex of the dome shaped heat shield heretofore contacted the nozzle assembly 10 at the junction point 34.

In FIG. 2 the anti-coking feature was accomplished by modifying the nozzle nut 28. The annular inwardly projecting portion 40 of nut 28 is dimensioned so that the space designated by reference letter A and the central opening 42 where the fuel is injected into the combustion zone designated by reference letter B, together with the diameter, number and angle of air swirl inlet holes 44 cause the pressure pattern of the swirling air admitted through the air swirl inlet holes 44 to cause a positive pressure in secondary passageway 14 when it is rendered inoperative.

In each of the nozzle configurations in FIGS. 1 and 2 it will be appreciated that the means for creating the anti-coking in the secondary passageway is by assuring that a negative pressure which heretofore existed never exists in the secondary fuel passageway 14. This can best be achieved by trial and error. That is by testing the fuel nozzle with modification of the pressure pattern to achieve a positive pressure in the secondary passageway throughout the fuel nozzle operating envelope.

Figure 3:
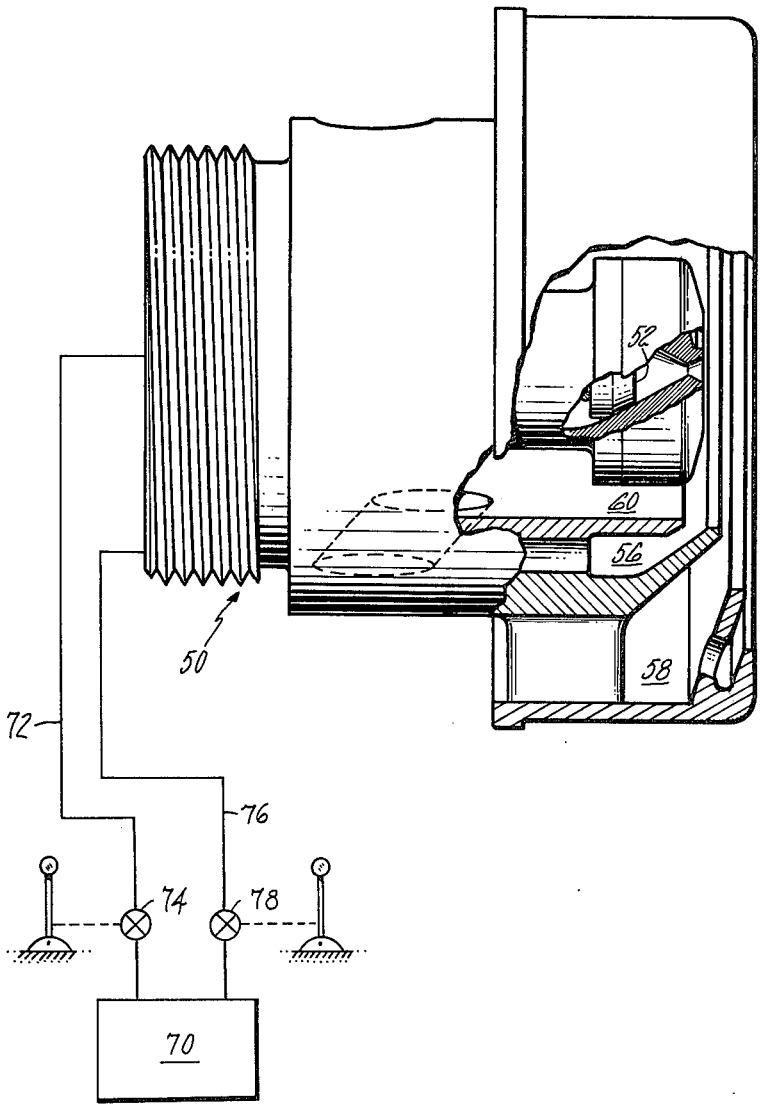
FIG. 3 is a partial view, partly in elevation and partly in section illustrating another dual orifice fuel nozzle with an aerating secondary fuel nozzle with the conventional primary pressure atomizing nozzle showing another embodiment of this invention.

FIG. 3 illustrates another type of dual orifice fuel nozzle that has been developed so as to achieve the anti-coking feature described in connection with FIGS. 1 and 2. As noted, FIG. 3 shows a dual orifice fuel nozzle with a pressure atomizing primary fuel system and an aerating or air atomizing secondary fuel system.

The nozzle and support generally illustrated by reference numeral 50 comprises the conventional primary nozzle and pintle assembly 52 injecting fuel in the combustion zone. Fuel is also introduced into the combustion zone through secondary fuel passageway 56. Swirling air in the passageways 58 and 60 create swirling airstreams that sandwich the conically shaped fuel stream emitting from secondary fuel passageway 56 to cause an atomizing effect.

Similar to the problem that created the coking of passageway 56 when only the primary fuel was operative, the pressure field adjacent passageway 56 tend to create a negative pressure therein, causing fuel to migrate thereto. Hence, the dimensioning of the passageways for a given combustion envelope serves to create a positive pressure in the secondary passageway whenever the primary passageway is the only operative fuel system.

As shown schematically in FIG. 3, which is also applicable with the embodiments of FIG. 1 and FIG. 2, fuel is fed from the fuel tank 70 to the primary passageway via line 72 and valve 74. Fuel to the secondary passageway is fed from the fuel tank 70 via line 76 and valve 78. Mechanical means are shown to operate valves 74 and 78 which merely represent the typical fuel control and fuel distribution systems that are well known.

It should be understood that the invention is not limited to the particular embodiments shown and described herein, but that various changes and modifications may be made without departing from the spirit and scope of this novel concept as defined by the following claims.

We claim:

1. A dual orifice type fuel nozzle for a combustor of gas turbine engine having a compressor, said fuel nozzle having a generally conically shaped casing with a primary fuel passage centrally disposed therein, secondary fuel passage formed therein concentrically disposed relative to the primary fuel passage, both primary and secondary passages exiting fuel into said combustor through a substantially mutual transverse plane, means for imparting a swirl component to compressor discharge air surrounding the fuel exiting from said primary and secondary passages, means for feeding fuel to said primary fuel passage so that it is normally continuously operative throughout the engine operating envelope and means for feeding fuel to said secondary fuel passage so that it is normally operative solely during the high thrust regimes and inoperative during the low thrust regimes of said engine operating envelope, means for pressurizing the secondary passage when said primary passage is solely operative with said compressor discharge air whereby said secondary passage maintains a positive pressure for preventing fuel from said primary passage from migrating therein and coking the walls of said secondary passage.

2. A dual orifice type fuel nozzle as claimed in claim 1 including a heat shield formed in a dome shaped element having an apex mounted adjacent said transverse exiting plane and the base mounted adjacent the wider diameter of said conically shaped casing, a plurality of apertures adjacent said base circumferentially formed in said dome shaped element, and said apex of said dome shaped element being spaced from the conically shaped casing for defining an exit passage for the compressor discharge air flowing through said plurality of apertures and the dimension of said apertures and said exit passage being selected to achieve a positive pressure in said secondary passage when said primary passage is solely operative.

3. A dual orifice type fuel nozzle as claimed in claim 1 wherein said means for imparting a swirl component to compressor discharge air includes a fuel nut mounted on the end of said conically shaped casing and having a central opening coaxially disposed relative to the axial axis of said primary passage, a dome shaped heat shield element having an apex attached to the apex of said conically shaped casing and a base end attached to the base of said conically shaped casing, annularly shaped wall means extending inwardly of said nozzle nut and defining a central opening coaxially disposed relative to said axial axis and being axially spaced from the apex of said dome element, the central opening of said wall means and said space being dimensioned so that the compressor discharge air being swirled by passages formed in the base end of said nut and discharging through said central opening pressurizes said secondary passage when the primary passage is solely operative.

4. For a dual orifice type fuel nozzle as in claim 1 including a first annular passage concentrically disposed between said secondary passage and said primary passage and a second annular passage concentrically mounted to and surrounding said secondary passage means for leading air discharging from said compressor into said first and second annular passages for commingling with the fuel emitted from said primary and secondary passages, means for imparting a swirl component to the air flowing in said first and second annular passages so that the air discharging therefrom swirls about said egressing fuel, said first and second annular passages being dimensioned so as to pressurize said secondary passage when the primary passage is solely operative.

* * * * *